US006201946B1

(12) United States Patent
Takeuchi et al.

(10) Patent No.: US 6,201,946 B1
(45) Date of Patent: Mar. 13, 2001

(54) MULTIPLE PRINTER SYSTEM WITH A ROUTE SETTING DEVICE FOR PRINTED SHEETS

(75) Inventors: Masakazu Takeuchi; Takao Hashimoto, both of Tokyo (JP)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/379,253

(22) Filed: Aug. 23, 1999

(30) Foreign Application Priority Data

May 28, 1999 (JP) ..... 11-149507

(51) Int. Cl.[7] ..... G03G 15/00; B65H 31/06

(52) U.S. Cl. ..... 399/381; 399/388; 399/397; 399/401

(58) Field of Search ..... 399/381, 124, 399/388, 391, 397, 401

(56) References Cited

U.S. PATENT DOCUMENTS 5,208,640 * 5/1993 Horie et al. ..... 399/110

5,852,764 * 12/1998 Kida et al. ..... 399/401

FOREIGN PATENT DOCUMENTS 60-48667 * 3/1985 (JP) .

* cited by examiner

*Primary Examiner*—Quana M. Grainger
(74) *Attorney, Agent, or Firm*—Newton H. Lee, Jr.

(57) ABSTRACT

A main printer that prints the cut papers fed from the paper feeding part and a support printer that prints and ejects the fed cut papers. The transporting part of the support printer has a cut paper transporting mechanism and a transporting control device. The cut paper transporting mechanism has a transporting route that transports the cut papers from the main printer to the inlet of the paper exit of the support printer or to the support printer and another transporting route that transports the cut papers exiting the support printer. It also has a transporting device that transports cut papers along the transporting routes. The transporting control device establishes the transporting route based on the given transporting destination specifying information and drives the transporting device.

7 Claims, 5 Drawing Sheets

101
R1
Cr1
Cr4
R2
11
7
R5
Cr3
R3
R4
9
92
91
81

MULTIPLE PRINTER SYSTEM WITH A ROUTE SETTING DEVICE FOR PRINTED SHEETS

FIELD OF THE INVENTION

This invention is related to a new printer system that connects two printers to work in coordination. Furthermore, for example, the invention is related to a printer system that has diversified printing functions such as black and white printing, color printing, overlay printing of black and white and color on a sheet of cut paper.

BACKGROUND OF THE INVENTION

Ordinary printers are composed of a paper feeding unit and a paper ejecting or output unit that are connected to the front and back of one printing unit. The paper-ejecting unit may be connected to a post-processing device such as a sorter, a mailbox, or a finisher (electric stapler and/or puncher) on the exterior of the paper ejecting unit.

Recent printers are likely to have color printing or overlay printing of color and black and white printing in addition to black and white printing.

The prior printing units are color printing unit, black and white printing unit, and both color and black and white printing unit. If a color printer equipped with a color printing unit is a color ink jet printer, the printing speed to realize the highly accurate printing is approximately 1 to 10 pages per minute, or ppm, and it is reasonably priced. Black and white printers equipped with a black and white printing unit have the moderate printing speed of approximately 20 ppm to the high printing speed of over 40 ppm. Their prices are relatively high. Black and white and color printers equipped with both black and white and color-printing units have the printing speed of 1 to 10 ppm for color printing and the moderate printing speed of 20 ppm for black and white printing. The electric photograph method is expensive and has high capacity. The ink jet method is less expensive and has low capacity.

When color printing is applied to a sheet of paper along with black and white printing, ordinary technology required is to set up both black and white printer and color printer or one black and white and color printer.

When two printers, black and white printer and color printer, are set up, each printer has a set of a paper feeding means, a printing means, and a paper ejecting means, requiring high facility cost. The biggest problem is that it requires a large space in an office. When color printing is applied to a sheet of paper after black and white printing has been applied, the paper ejected from one printer needs to be manually carried over to the other printer to start printing. Therefore, efficiency of office administration is low.

And, in order to automatically process the printed cut papers with sorting, stapling, and punching a post processing machine needs to be connected to the exterior of the printer on the paper ejecting side. When the ordinary method of using two printers, a black and white printer and a color printer, is used, each printer is equipped with its own post processing machine, which increases facility cost and decreases usage efficiency of interior office space.

Furthermore, a black and white and color printer resolves the office space issue to a certain degree, but the printing speed is restricted to low speed for color printing and moderate speed for black and white printing. The biggest problem is its high cost.

As stated above, ordinary printers have problems in either or both facility cost and occupying space when black and white printing and color printing are administered.

SUMMARY OF THE INVENTION

This invention was designed upon considering the above circumstances.

The first issue is to provide a printer system that can administer black and white printing, color printing, and overlay printing of black and white and color to a sheet of paper by one printer and that is able to reduce required time and cost and to minimize occupied space.

Another issue is that the above printer system can have an option to choose to eject the printed cut papers ejected from a printer either to the paper ejecting part in the printer system or to the post processing machine outside of the printer system.

An additional issue is to provide the printer system that can administer overlay printing of color and black and white to a sheet of paper and that can separately or simultaneously administer color printing and black and white printing to different sheets of papers.

Further, an issue is that the above printer system can eject the printed cut papers ejected from the printer to the paper ejecting part and/or the post processing machine either face-up or face-down.

In order to solve the above issues, the printer system of this invention, first of all, is composed of a main printer and a support printer. Second, the main printer has the paper feeding means, the transporting means, and the printing means. The cut papers are fed from the paper feeding means through the transporting means. They are printed in the printing means and the printed cut papers are ejected through the transporting means. Third, the support printer has the paper feeding means, the transporting means, the printing means, and the paper ejecting means. The printing means of the support printer prints the cut papers fed from the paper feeder and the printed cut papers are ejected from the paper ejecting outlet. The paper feeding means of the support printer feeds the cut papers to the paper feeder of the printing means of the support printer. The paper ejecting means of the support printer stores and accumulates the cut papers inserted from the specified inserting inlet so that the papers can be removed from outside of the support printer. The transporting means of the support printer has a cut paper transporting mechanism and a transporting control device. The cut paper transporting mechanism has the transporting route to transport the cut papers ejected from the main printer toward the inserting inlet of the paper ejecting means or the paper feeder of the printing means of the support printer and the transporting route to transport the cut papers ejected from the paper ejecting outlet of the printing means of the support printer toward the inserting inlet of the paper ejecting means. It also has the transporting device to transport the cut papers along the transporting route. The transporting control device establishes the said transporting routes based on given transporting destination specifying information and activates the transporting device.

The above composition enables the cut papers fed from the paper feeding means of the main printer to be printed by the printing means of the main printer and the printed cut papers to be printed over by the printing means of the support printer and to be transported to the paper ejecting means of the support printer. Also, the cut papers fed from the paper feeding means of the support printer are printed by the printing means of the support printer and then the printed cut papers are transported to the paper ejecting means of the support printer.

The said cut paper transporting mechanism has the transporting route to transport the cut papers ejected from the main printer to either the inserting inlet of the paper ejecting means, the post processing machine connected to outside of the support printer, or the paper feeder of the printing means of the said support printer, whichever is specified. It also has the transporting route to transport the cut papers ejected from the paper ejecting outlet of the printing means of the said support printer toward either the inserting inlet of the said paper ejecting means or the said post processing machine, whichever is specified.

Such construction enables the cut papers fed from the paper feeding means of the main printer to be printed by the printing means of the main printer based on the contents of given transporting destination specifying information. Then, the printed cut papers are transported to the paper ejecting means of the support printer or the post processing machine directly or after they are printed over by the printing means of the support printer, based on the contents of the different transporting destination specifying information.

The main transporting route ejects the cut papers to the paper ejecting outlet at the outside of the main printer after sending the cut papers sent from the paper feeding means of the main printer through the printing means of the main printer. The support transporting route ejects the cut papers to the ejecting outlet at the outside of the main printer without sending them through the printing means of the main printer. The transporting route specifying device sends the cut papers sent from the paper feeding means based on given transporting destination specifying information through either the said main transporting route or the said support transporting route.

After the cut papers are printed by the main printer or further printed over by the support printer, they are transported to the paper ejecting means of the support printer or the post processing machine. The cut papers fed from the paper feeding means of the main printer are sent to the printing means of the support printer based on the specified control information input and the transporting destination specifying information input without being printed by the main printer. The papers are transported to the paper ejecting means of the support printer or the post-processing machine after being printed by the printing means of the support printer.

By enabling the paper feeding means of the main printer to store the papers that cannot be stored in the paper feeding means of the support printer, for example, cut papers of different thickness and size, special cut papers, or unique papers such as transparencies or hand print cards, the support printer can print the papers that cannot be printed by using only the support printer and ejects papers to the paper ejecting means or the post processing machine.

The cut paper transporting mechanism has (a) the first transporting route from the paper ejecting inlet of the main printer to the inserting inlet of the paper ejecting means of the support printer, (b) the second transporting route that is separated from the middle of the front portion of the first transporting route, through the support printer, and connected to the transporting path of the post processing machine, (c) the third transporting route that is separated from the middle of the front part of the first transporting route and reaches the paper feeder of the printing means of the support printer, (d) the fourth transporting route from the paper ejecting outlet of the printing means of the support printer to the inserting inlet of the paper ejecting means, and (e) the fifth transporting route that is separated from the middle of the front part of the fourth transporting route and merges into the middle of the second transporting route.

The printed cut papers ejected from the main printer by the construction of the said cut paper transporting mechanism and the transporting control device are transported toward the paper ejecting means or the post processing machine through the first transporting route or the second transporting route at different times. The papers are fed to the printing means of the support printer through the third transporting route. The printed cut papers ejected from the printing means of the support printer can be transported toward the paper ejecting means or the post processing machine through the fourth transporting route or the fifth transporting route. If the printed cut papers ejected from the main printer are ejected toward the paper ejecting means and the printed cut papers ejected from the support printer are ejected toward the post processing machine, the main printer and the support printer can simultaneously print the cut papers.

It is desirable that the said cut paper transporting mechanism be composed of a common transporting path in the middle of the third transporting route that is separated from the middle of the front portion of the first transporting route and in the middle of the fourth transporting route from the paper ejecting outlet of the printing means of the support printer to the inserting inlet of the paper ejecting means of the said support printer. The cut paper transporting direction at the common transporting path should be able to be set in either way.

With this construction, the cut papers ejected from the main printer can be fed to the printing means of the support printer by selecting the cut paper transporting direction at the common transporting path for that direction. The cut papers ejected from the printing means of the support printer can be transported toward the paper ejecting means or the post processing machine by selecting the other direction. By sharing the common transporting path, the cut paper transporting mechanism can be simplified.

The cut paper transporting mechanism should also have a sixth transporting route that is separated from the middle of the rear portion of the second transporting route and merges into the fourth transporting route at a location near the inserting inlet of the paper ejecting means. The cut paper transporting direction at the transporting path from the divergent point of the second transporting route and the sixth transporting route to the end of the second transporting route should be able to switch in either direction.

Such a construction temporarily stops the cut papers transported to the transporting path from the divergent point of the second transporting route and the sixth transporting route to the end of the second transporting route. By switching the transporting direction, the cut papers can be transported toward the paper ejecting means along the sixth transporting route. The printed cut papers ejected from the printing means of the main printer or the support printer can be inverted and transported toward the paper ejecting means.

It is desirable that the main printer be a black and white printer and the support printer be a color printer. If the above conditions are met, a relatively less expensive main printer administers frequently used black and white printing at high speed. The reasonably priced support printer can administer highly accurate color printing. Furthermore, black and white and color overlay printing can be efficiently done in short time.

The route establishing unit can be composed of two straight paths that cross each other and connect a part of the cut paper transporting mechanism, four curved paths that connect neighboring divergent points or merging points among the divergent points or the merging points placed in the specified distance from the cross connection of that straight paths, and the route creating device that specifies to connect the said straight paths either to left or right curved path at each divergent point or the merging point. The route establishing unit was created as a reversed symmetry around the cross connection of the straight paths.

If the route establishing unit is used, the said first transporting route to the sixth transporting route can be easily established by selective control to activate the route creating device. And, since it is created in symmetry, the direction does not matter during installation.

DESCRIPTION OF THE PREFERRED EMBODIMENT

The printer system of this invention is composed of a main printer A and a support printer B. The main printer A and the support printer B, as indicated in FIG. 1, can be structured by being connected to each other in housings 1 and 2 with the specified relationship, or, as indicated in FIG. 2, they can be stored in one common housing 3.

Figure 1:
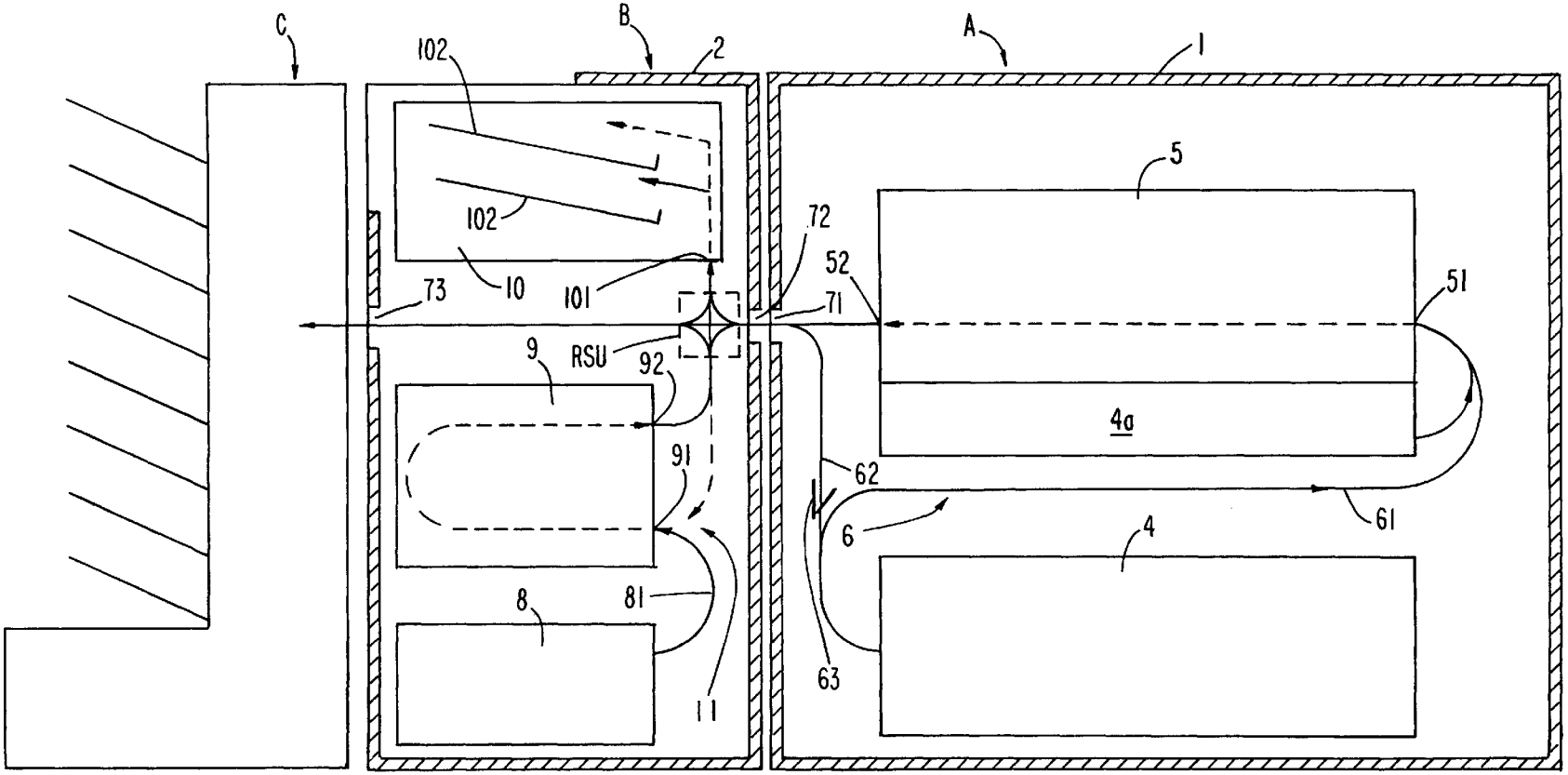
FIG. 1 is a vertical section that indicates an example of the composition of the printer system of the invention.
Figure 2:
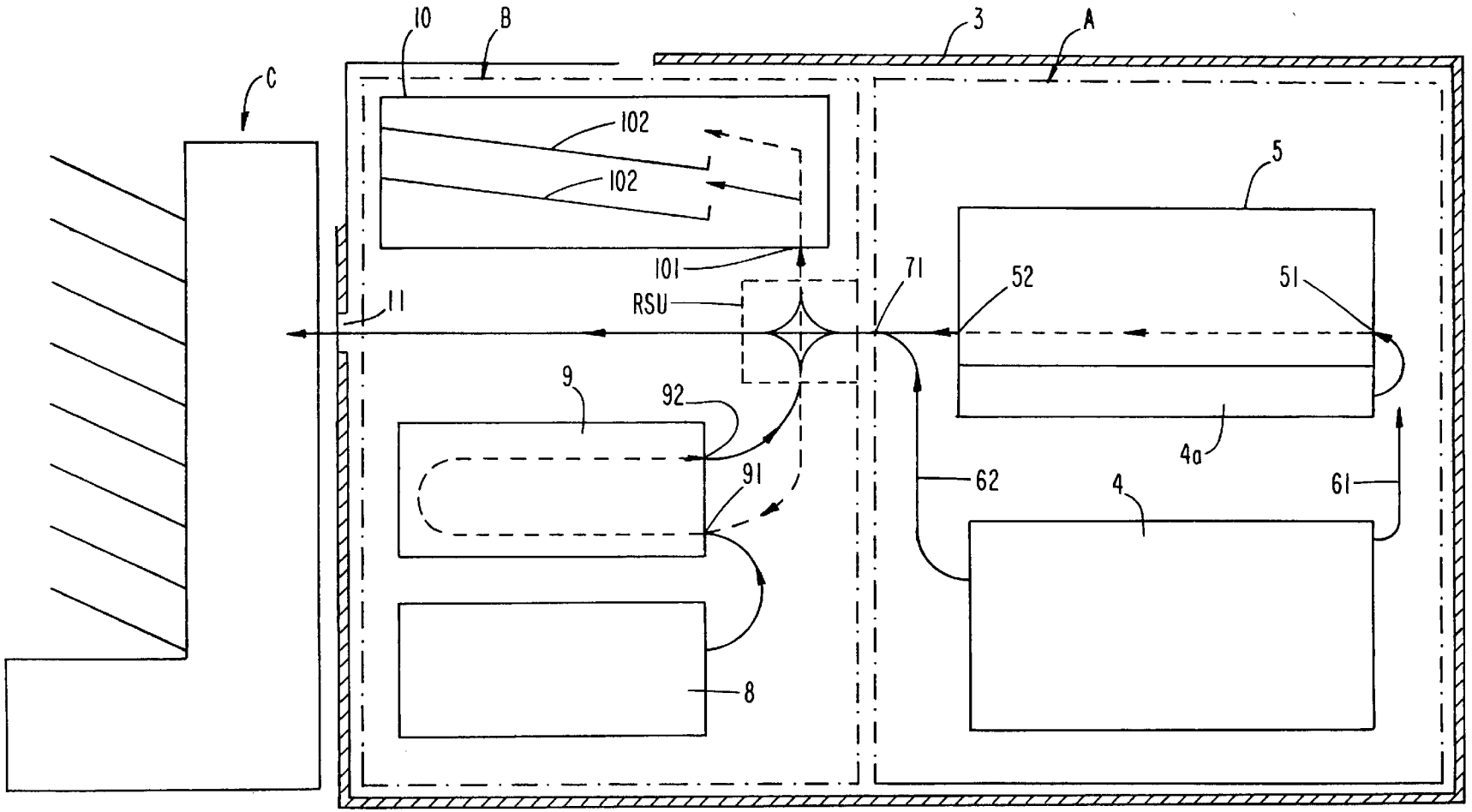
FIG. 2 is a vertical section that indicates another example.

In FIGS. 1 and 2, C is a known post processing machine that is connected to the exterior of the support printer. As shown, the post processing machine C is a sorter. It can be one or more combinations of sorter, mail box, finisher, binder, folding machine, or envelop sealing machine. Since the post-processing machine is not directly related to the main purposes of this invention, it is explained later according to the relationship to this invention.

The main printer A is a black and white printer that can print at moderate speed or likely at high speed. It has at least one paper feeding means 4 that sends the stored cut printing papers, the printing means 5 that administers black and white printing to the cut papers fed from the paper feeding means, and the transporting means 6 that transports the cut papers sent from the paper feeding means along the specified transporting route.

Instead of or in addition to the paper feeding means 4, another paper feeding means 4*a* can be installed. In this case, 4 is a main paper feeding means and 4*a* is a support paper feeding means. The main paper feeding means 4 can store medium or large capacity of 1,000 to 5,000 sheets of papers. This main paper feeding means can store special papers such as cut papers or printed cut papers that are thicker or larger than regular paper. It can also store unique papers such as OHP (Over Head Projector) papers or white notes. Various sizes of paper cassettes can be replaced. The paper cassette with a paper position specifying device to match each size can be installed. The support paper feeding means 4*a* stores regular papers with frequently used sizes and textures.

Each paper feeding means 4 and 4*a* has a known sending device (not shown) that is composed of a motor, a deceleration gear, a sending roller, and a guiding board. It sends out the top cut paper that is stored in the paper cassette one by one.

The printing means 5 sends the cut papers fed from the paper feeding means 4 or 4*a* into the inserting inlet 51 at constant speed by a built in paper sending device. It administers black and white printing on the cut papers and ejects them from the paper ejecting outlet 52 based on the printing commands and data given by the later mentioned top device F (FIG. 6).

The transporting means 6 has the main transporting route 61 that leads the cut papers sent out from the main paper feeding means 4 to the paper ejecting outlet 71 at the end of the paper transporting path of the main printer A from the main paper feeding means 4 through the printing means 5. It also has the support transporting route 62 that leads the cut papers from the main paper feeding means 4 to the paper ejecting outlet 71 through the printing means 5. Either transporting route has a known transporting device (not shown) that is composed of a transporting roller to transport the cut papers in the specified direction and a motor to rotate the transporting rollers, as customary.

Also, this is a transporting route specifying device 63 that is made of, for example, a freely rotating wing and a solenoid to move that wing, to specify whether the main transporting route 61 or the support transporting route 62 sends out the cut papers sent from the paper feeding means 4.

The main transporting route 61 and the support transporting route 62 of the transporting means 6, as indicated by an example in FIG. 2, can be made to transport the cut papers from both sides of the paper feeding means 4 to the inserting inlet 51 and the paper ejecting outlet 71 of the printing means 5. The paper ejecting outlet 71 is directly connected to the inserting inlet 72 at the beginning of one transporting route that composes the later described cut paper transporting mechanism of the support printer B. In an example indicated in FIG. 2, the main printer and the support printer are stored in one box and the paper ejecting outlet 71 and the inserting inlet 72 are connected.

The support printer B is preferably a reasonably priced and highly accurate color printer such as color ink jet printer. It has a paper feeding means 8, a printing means 9, a paper ejecting means 10, and a transporting means 11.

The paper feeding means 8 has the cassette (not shown) that stores applicable cut papers for color printing and the known sending device (not shown) that sends the top sheet of cut papers in a cassette one by one whenever it receives an activating signal.

The printing means 9 sends the cut papers inserted from the paper feeder at constant speed by the paper sending device that is built inside of the printing means 9. After color printing is administered onto the cut paper, the printing means 9 ejects it from the paper ejecting outlet 92. The support printer that composes the printer system of this invention has the inserting inlet 91 and the paper ejecting outlet 92 on the same side, for example, on the main printer A side.

The paper ejecting means 10 has one or more paper ejecting trays 102 placed in a position where the printed cut papers can be removed from the top of the support printer. It is known to eject the cut papers that have been sent to the inserting inlet 101 by the later mentioned cut paper transporting mechanism to the specified paper ejecting tray. If more than one paper ejecting tray is installed, the paper ejecting means 10 has a known sorting device (not shown) that is made of a wing and solenoid, for example, to selectively rotate that wing in order to eject the cut paper inserted from the inserting inlet 101 to the specified paper ejecting tray.

If there is enough space in the support printer B, the number of paper ejecting trays can be increased to be used as a sorter or a mailbox. And, a finisher (equipped with an electric stapler or a puncher) and a binder can be added. That is, the paper ejecting part 10 can be one or more combinations of sorter, mailbox, finisher, binder, envelope sealing machine, and booklet making machine as long as it does not interfere with the post processing machine.

The transporting means 11 of the support printer B transports the cut papers that are ejected from the paper ejecting means 71 of the main printer A or sent from the paper feeding means 8 of the support printer along the transporting route established by the specifications of the later described driving mode. It finally sends the cut papers to the paper ejecting outlet 73 located on the side of the inserting inlet 101 of the paper ejecting means 10 or the post processing machine C. Generally, it is composed of the cut paper transporting mechanism and the transporting control device.

Figure 3:
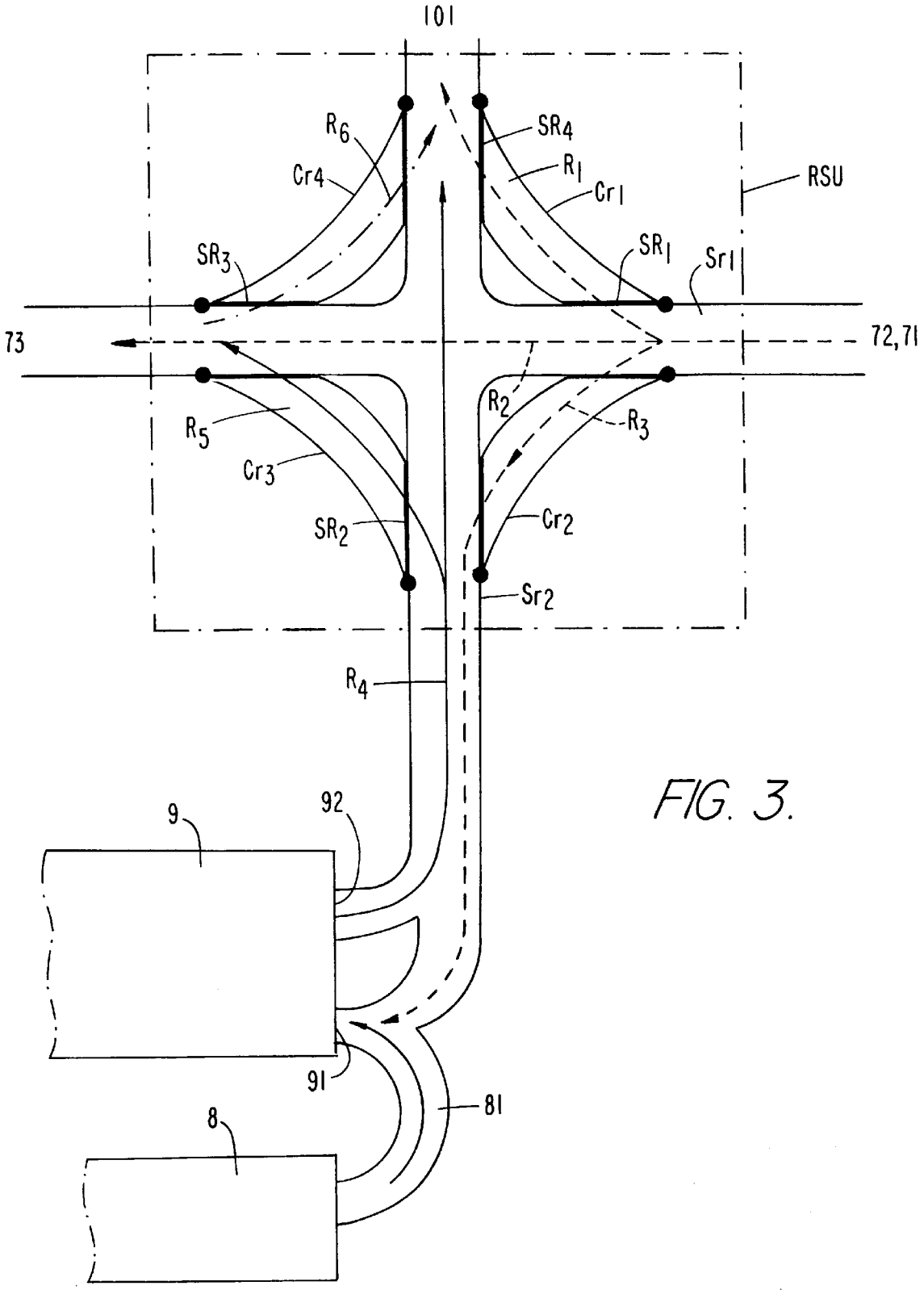
FIG. 3 is a drawing that indicates the major part of one example of the cut paper transporting mechanism of the support printer.

The cut paper transporting mechanism has, as indicated in an example in FIG. 3, the following functions. The first transporting route R1 is between the paper ejecting means 71 of the main printer A and the inserting inlet 101 of the paper ejecting means 10 of the support printer B. The second transporting route R2 is separated from the middle of the front portion of the first transporting route R1, goes through the support printer B, and reaches the paper ejecting outlet 73. The third transporting route R3 is separated from the middle of the front portion of the first transporting route R1 and reaches the paper feeder 91 of the printing means 9 of the support printer. The fourth transporting route R4 is placed from the paper ejecting outlet 92 of the printing means 9 of the support printer to the inserting inlet 101 of the paper ejecting means 10. The fifth transporting route R5 is separated from the middle of the front portion of the fourth transporting route and merges into the middle of the rear portion of the second transporting route R2. The cut paper transporting mechanism also has transporting rollers (not shown) located along each transporting path, the route creating devices SR1 to SR4 located at the divergent point or the merging point of each transporting path, and a motor (not shown) that rotates the said transporting rollers toward the specified direction, all as well recognized in the art.

The cut papers that are sent out by the sending device of the paper feeding means 8 of the support printer B can be fed to the printing means 9 of the support printer by sending the cut papers to the paper feeder 91 of the printing means through the transporting path 81 as indicated in the FIGS. 1 and 3. The cut papers can also be fed directly into the printing means 9 without using the transporting path 81.

RSU in FIGS. 1 and 3 is the route setting unit that comprises a portion of the cut paper transporting mechanism. It is a unit that has two straight paths, SR1 and SR2, that are crossed over and connected to each other and four curved paths Cr1 to Cr4 connecting the divergent point or the merging point facing each other among the divergent points or the merging points placed a specified distance from the cross connection of the straight path. RSU has the route making devices SR1 to SR4 that use the wing with a center support on the outside edge of each divergent point or the merging point to decide if the said straight path should be connected to either left or right curved path at each divergent point or merging point. RSU is made in reversed symmetry around the cross connection of the straight path.

The route creating devices SR1 to SR4, for example, can be composed of pairs of wings or gates that can pivot to both sides of the transporting paths by use of a solenoid, for example, that individually rotates each pair of wings to the specified position according to the cut paper transporting destination. Depending on whether or not each wing or gate is stopped at either of three positions, the said transporting route can be selectively made.

Each route-creating device SR1 to SR4 holds the wing in a regular position that opens the straight paths SR1 and SR2. When moved, to either left or right, the straight paths SR1 and SR2 connect one side of either of the neighboring curved paths cr1 to cr4 to the outside of the straight path.

The route setting unit RSU has a structure of reversed symmetry around the cross connection of the straight path. It does not distinguish top and bottom or left and right and it can be installed easily.

The cut paper transporting mechanism indicated in the FIG. 3 can (a) transport the cut papers ejected from the paper ejecting outlet 71 of the main printer to the inserting inlet 101 of the paper ejecting means 10 of the support printer through the first transporting route R1, (b) transport them from the paper ejecting outlet 73 to the post processing machine C through the support printer by the second transporting route R2, (c) transport them to the paper feeder 91 of the printing means 9 of the support printer through the third transporting route R3. The cut paper transporting mechanism can also (e) transport the cut papers ejected from the paper ejecting outlet 92 of the printing means 9 of the support printer to the inserting inlet 101 of the paper ejecting means through the fourth transporting route R4, (f) transport them from the paper ejecting outlet 73 to the post processing machine C through the fifth transporting route R5, and (g) transport them inversely to the inserting inlet 101 of the paper ejecting means 10 through the sixth transporting route R6 after transporting the rear edge of the cut paper to a position beyond the route creating device SR3 through the fifth transporting route R3 or R5.

The transporting roller located in the common transporting path of the third transporting route R3 and the fourth transporting route R4 and the transporting roller located in the partial transporting path between the route creating device SR3 of the second transporting route R2 and the paper ejecting inlet 73 can switch the cut paper transporting directions of the said common transporting path or the partial transporting path by being rotated by a reversible motor.

If the distance between the route setting device SR4 of the straight path SR2 that composes the fourth transporting route R4 and the inserting inlet 101 of the paper ejecting means 10 is longer than the length of the paper, the printed cut papers ejected from the main printer A can be transported inversely to the post processing machine C through the first transporting route R1, the sixth transporting route R6, and the second transporting route R2, or the printed cut papers ejected from the printing means 9 of the support printer B can be transported inversely to the post processing machine C through the fourth transporting route R4, the sixth transporting route R6, and the second transporting route R2 by enabling the transporting direction of the partial transporting path and the curved path Cr4 to be reversed.

Figure 4:
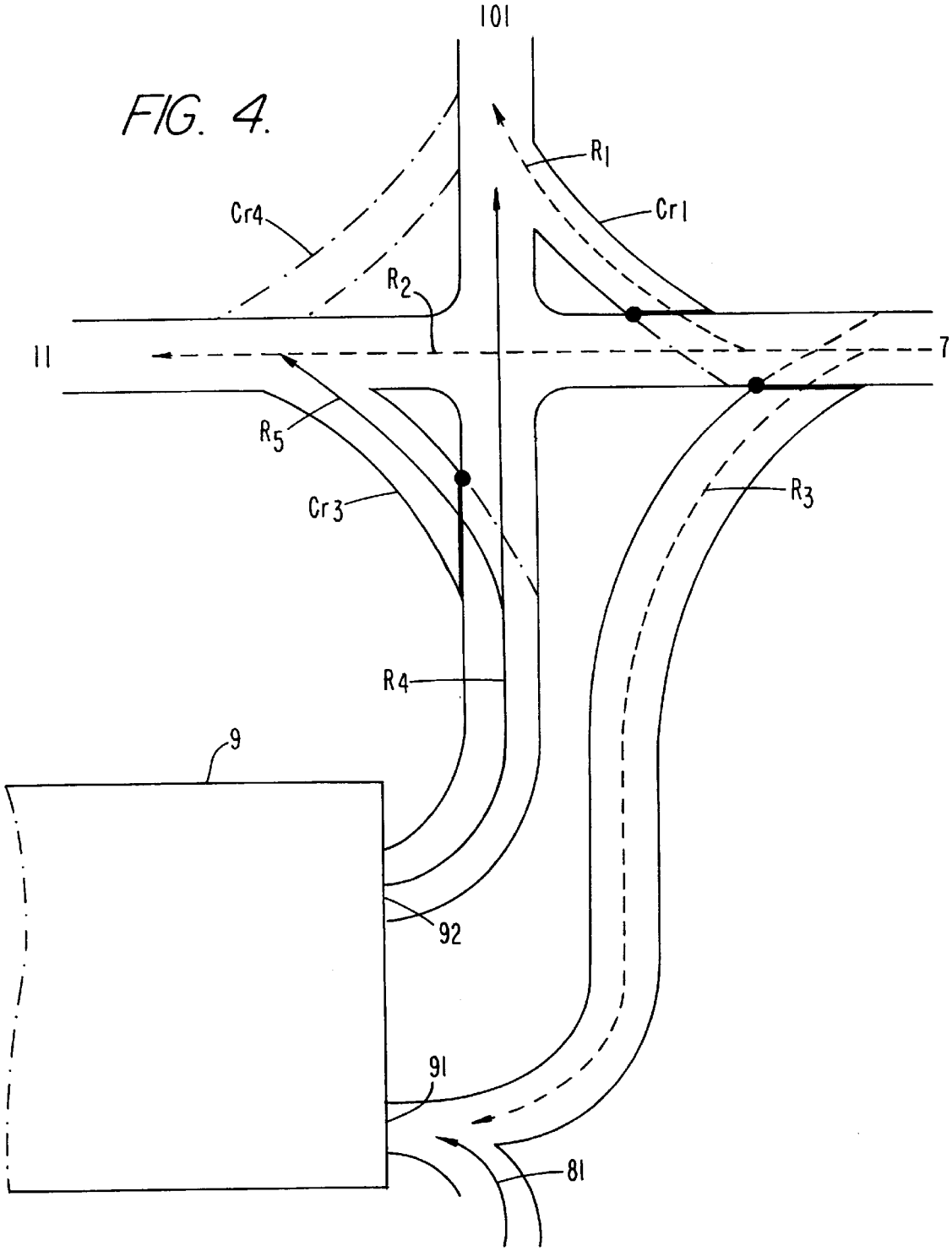
FIG. 4 is a drawing that indicates the main part of another example.

The transporting route of the cut paper transporting mechanism can be constructed so that the third transporting route R3 and the fourth transporting route R4 can use different transporting paths as indicated in the FIG. 4. In this case, while the printed cut papers are ejected from the paper ejecting outlet 92 of the support printer, the cut papers ejected from the main printer A can be transported to the paper feeder 91 of the printing means 9 of the support printer B to improve the through-put function.

Figure 5:
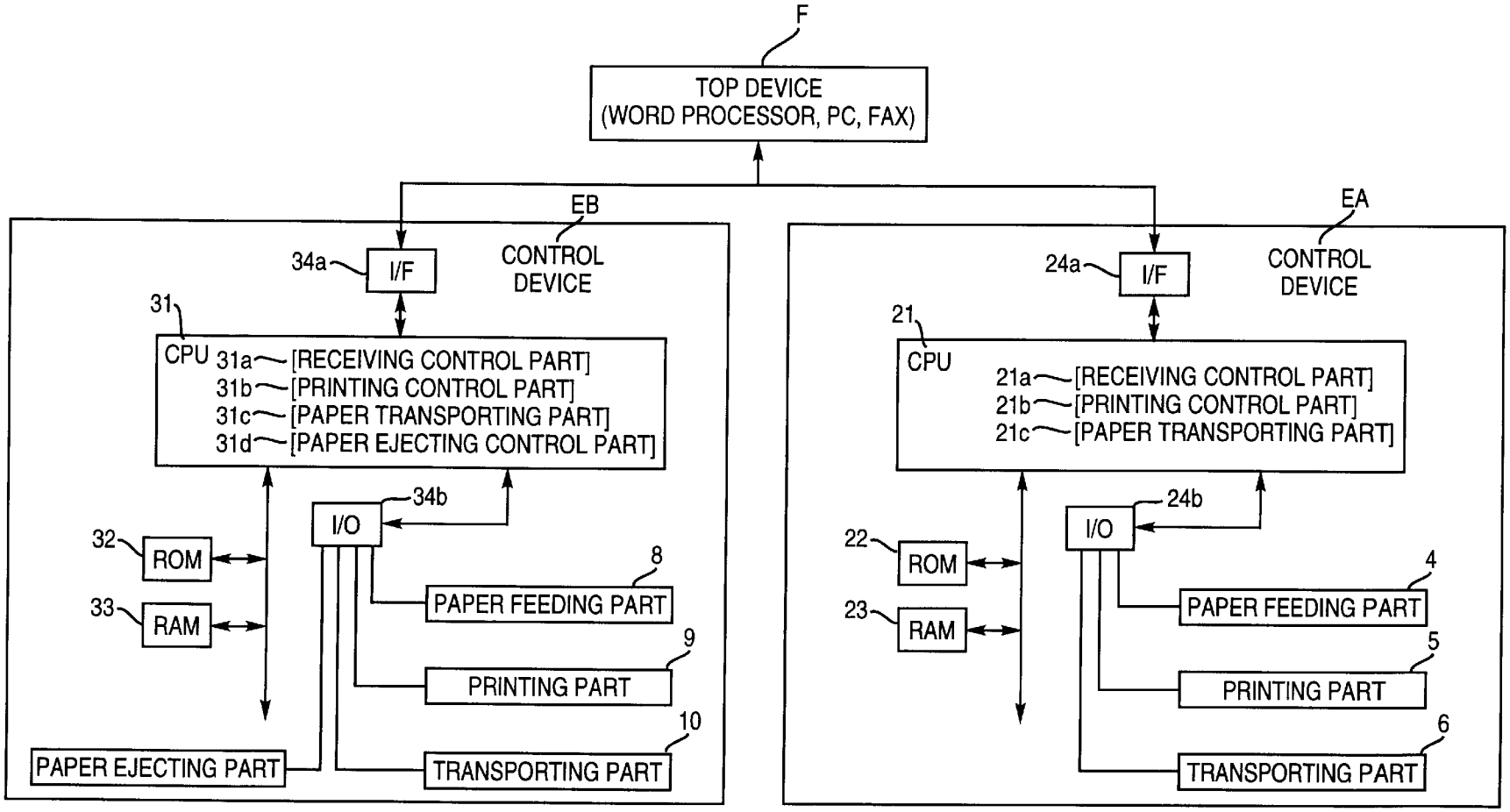
FIG. 5 is an example of the composition of an operating system.

Referring to FIG. 5, the main printer A has the control device EA to control the paper feeding means 4, the printing means 5, and the transporting means 6. The support printer B has the control device EB to control the paper feeding means 8, the printing means 9, the paper ejecting means 10, and the transporting means 11. The top device F is connected to each control device EA and EB.

The top device F outputs printing data and commands such as a personal computer, a word processor, or a facsimile. It sets up the printer system of this invention with desired operative conditions. For example, touch switches on an operational panel or a screen can be pushed to enter data and commands or key or cursor operations can be used to enter data and commands by using letters indicated on the screen in a conversational style. The said operational conditions mean driving modes, the ejecting destination of the cut papers, and the existence of inverted transporting.

The driving mode has the first mode (MD1) that causes the main printer A to administer only black and white printing, the second mode (MD2) that enforces the support printer B to administer only color printing, the third mode (MD3) that enforces overlay printing of black and white printing by the main printer A and color printing by the support printer B, and the fourth mode (MD4) that enforces the support printer to administer color printing on the cut papers that are fed from the main paper feeding means 4 of the main printer A to the support printer B through the support transporting route 62.

Ejecting destination can be specified in the first ejecting direction specification that ejects to the ejecting means side of the support printer B and in the second ejecting direction specification that ejects to the post processing machine C side. Either the first ejecting direction or the second ejecting direction can specify either inverted transporting or non-inverted transporting.

When the above mode specification, ejecting destination specification, and no specification or specification for inverted transporting are completed, they are given from the top device F to each control device EA and EB as control information.

The control device EA of the main printer A is composed of the CPU21 that controls each means, the ROM22 that contains the program to administer the main printer black and white printing, and the RAM23 that provides work area. The CPU21 is connected to the top device F through the interface 24*a* and also connected to the paper feeding means 4 or 4*a*, the printing means 5, and the transporting means 6 of the main printer A.

The CPU21 has the data receiving control means 21*a*, the printing control means 21*b*, and the transporting control means 21*c*. It activates the specified program by the same method as the ordinary printers and controls the printing activities of the main printer. That is, the data receiving control means 21*a* controls the reception of the printing information from the top device F. The printing control means 21*b* gives the printing data and commands for black and white printing to the printing means 5 of the main printer A based on the printing information. The transporting control means 21*c* controls the transporting means 6 based on the control information (driving mode specification, ejecting destination specification, and invert transporting specification) that are entered from the said top device.

Control commands may contain the paper specifying information that specifies paper size, etc.

If the fourth mode is specified for the main printer A, the cut papers with the specified size are fed to the support printer from the main paper feeding means 4 without printing. In that case, the CPU21 controls the sending device of the main paper feeding means 4 based on the mode specifying input from the top device F and controls the transporting means 6.

The control device EB of the support printer B is composed in similar way. It is composed of the CPU31 that controls each means, the ROM32 that stores the program to administer the support printer for color printing, and the RAM33 that provides work area. The top device F is connected to the CPU through the interface 34*a*. And, the paper feeding means 8, the printing means 9, the paper ejecting means 10, and the transporting means 11 of the support printer A are connected to the CPU through the interface 34*b*.

The CPU31 has the data reception control means 31*a*, the printing control means 31*b*, the transporting control means 31*c*, and the paper ejecting control means 31*d* as a means to realize its functions.

The data reception control means 31*a* controls the reception of the printing information from the top device F. The top device FB gives the printing data and control commands to the support printer B to administer color printing.

The printing control means 31*b* activates the specified program by the similar method as ordinary color printers. It controls the printing operation of the support printer. It gives the printing data and control commands to administer color printing to the printing means 9 of the support printer B based on the printing information and activates printing.

The transporting control means 31*c* activates its own transporting control for the printer system of the invention to the cut paper transporting mechanism in order to transport the printed cut papers to the ejecting destination that corresponds to the input conditions based on the control information (driving mode specification, ejecting destination specification, invert transporting specification) that are entered from the top device F. It gives necessary control signals to the transporting device and the transporting route setting device that is subject of control for the transporting means 11.

The paper ejecting control means 31*d* controls the sorting device of the paper ejecting means in order to eject the printed cut papers to the specified paper ejecting tray.

The operations of the printer system when various driving modes and ejecting directions are specified are described in the next section.

Chart 1 indicates the relationships of various combination of the specified driving modes, ejecting destinations, and the existence of invert transporting and the transporting routes of cassette papers. They will be described in order along with the control of the route creating devices SR1 to SR4. The first mode and the fourth mode will be addressed MD1 and MD4 respectively and the ejection toward the paper ejecting means and the ejection toward the post processing machine direction will be addressed O1 and O2 respectively.

CHART 1

Relationship of the driving mode specification and the ejecting specification and the cut paper transporting routes.

Types of Driving Modes

Mode 1: Only black and white printing by the main printer

Mode 2: Only color printing by the support printer

Mode 3: Black and white printing by the main printer and color printing by the support printer Mode 4: The support printer administers color printing on the blank papers fed from the main printer Types of the Ejecting Destinations O1: Paper ejecting means; O2: Post processing machine

| Specified Mode | Ejecting Destination | Transporting Route | Transporting Routes during Invert Specification |
|---|---|---|---|
| MD1 | O1 | 4 (4a) > 5 > RSU R1 > 101 | 4 (4a) > 5 > RSU R2 > R6 > 101 |
| | O2 | 4 (4a) > 5 > RSU R2 > 73 | 4 (4a) > 5 > RSU R1 > R6 > R2 > 73 |
| MD2 | O1 | 8 > 9 > R4 > RSU R4 > 101 | 8 > 9 > R4 > RSU R5 >R2 > R6 > 101 |
| | O2 | 8 > 9 > R4 > RSU R5 > R2 > 73 | 8 > 9 > R4 > RSU R4 > R6 > R2 > 73 |
| MD3 | O1 | 4 > 5 > RSU R3 > 9 > R4 > 101 | Same as left from 4 to 9 > The rest is the same as the third row. |
| | O2 | Same as above from 4 to 9 > RSU R5 > R2 > 73 | Same as left from 4 to 9 > The rest is the same as the fourth row. |
| MD4 | O1 | 4 > Support Route > RSU R3 > 9 > R4 > 101 | Same as left from 4 to 9 > The rest is the same as the third row. |
| | O2 | Same as above from 4 to 9 > RSU R5 > > 73 | Same as left from 4 to 9 > The rest is the same as the fourth row. |

1) If MD1 and O1 are specified, (a) When inverted transporting is not specified, First of all, the route creating devices SR1 and SR4 are activated and the first transporting route R1 is established.

When the main printer A starts, the cut papers are fed to the printing means 5 from the main paper feeding means 4 through the main transporting route 61. After printing the printing information given from the top device FA, the cut papers are ejected to the paper ejecting means 71. And, the support printer B ejects the cut papers that are inserted in the paper ejecting means 10 from the inserting means 101 through the first transporting route R1 by the cut paper transporting mechanism onto the specified paper ejecting tray 102, face up, by the divided ejecting device activated by the paper ejecting control means 31*d*.

(b) When inverted transporting is specified,

While maintaining the route-creating device SR1 and the route-creating device SR3 on regular positions, the second transporting route R2 is established. And, the main printer A, similar to the case in (a) of the section, feeds the cut papers from the main paper feeding means 4 and prints them in the printing means 5. The printed cut papers that are transported to the cut paper transporting mechanism of the support printer B are transported through the second transporting route R2 until the rear edge of the cut paper passes the route creating device SR3 and stops transporting. Then, after the sixth transporting route R6 is established by activating the route creating device SR3 and SR4, the transporting direction of the rear of the second transporting route R2 is reversed and the cut papers are transported to the inserting portion 101 through the sixth transporting route R6. Therefore, the cut papers are ejected to the specified paper ejecting tray 102 of the paper ejecting means, for example, face down.

(2) If MD1 and O2 are specified, (a) When inverted transporting is not specified, While maintaining the route creating device SR1 and the route creating device SR3 in the regular position, the second transporting route R2 is established and the printed cut papers that are ejected from the main printer are transported through the second transporting route R2 until they are ejected from the paper ejecting means 73.

(b) When inverted transporting is specified,

The first transporting route R1 is established by activating the route-creating device SR1 and SR4. The printed cut papers that are ejected from the main printer are transported toward the paper ejecting means through the first transporting route R1. When the rear edge of the cut paper passes the route-creating device SR4, it stops transporting. The sixth transporting route R6 is established by activating the route creating device SR4 and SR3 and the transporting direction of a partial transporting path at least between the route creating device SR4 and the inserting means of the paper ejecting means is reversed. The cut paper is ejected toward the post processing machine C from the paper ejecting means 73 through the rear portion of the sixth transporting route and the second transporting route.

(3) If MD2 and O1 are specified, (a) When inverted transporting is not specified, In this case, the main printer A is not activated. The fourth transporting route SR4 is established for the support printer B while maintaining the route-creating device RS2 and SR4 in regular positions. And, the support printer 13 feeds the cut papers from the paper feeding means 8 to the printing means 9. After the printing information given from the top device FB is printed by the printing means, the cut paper is ejected from the paper ejecting means 92 of the printing means, transported to the inserting means 101 through the fourth transporting route R4, and ejected to the specified paper ejecting tray of the paper ejecting means 10, for example, face up.

(b) When inverted transporting is specified,

In this case, the support printer B activates the route crating devices RS2 and RS3 to establish the fifth transporting route R5. And, the cut papers are fed from the paper feeding means 8 to the printing means 9. After the cut paper is printed by the printing means, the cut paper ejected from the paper ejecting means 92 of the printing means 9 is transported to the rear portion of the second transporting route R2 until the rear edge of the cut paper passes the route creating device R3 through the fifth transporting route R5. Then, after the transporting is temporarily stopped, the route creating devices SR3 and SR4 are activated to establish the sixth transporting route R6 and the transporting direction of a partial transporting path at least between the route creating device SR3 and the end of the second transporting route is switched to transport the cut paper to the inserting means 101 of the paper ejecting means 10 through the sixth transporting route R6. Therefore, the printed cut papers are ejected to the specified paper-ejecting tray, for example, face down.

(4) If MD2 and O2 are specified, (a) When inverted transporting is not specified, In this case, the main printer A is not activated. The support printer B establishes the fifth transporting route 5 and the cut papers are fed from the paper feeding means 8 to the printing means 9. After the cut paper is printed by the printing means, the cut papers ejected from the paper ejecting means 92 of the printing means 9 are transported through the fifth transporting route R5 until it is ejected from the paper ejecting means 73 at the end of the second transporting route R2.

(b) When inverted transporting is specified, (3) Like in (a) just above, the printed cut papers are ejected from the printing means 9 while the fourth transporting route R4 is established. After the cut paper is transported until the rear edge of the cut paper passes the route-creating device SR4, the transporting is temporarily stopped. The sixth transporting route R6 is established by activating the route creating devices SR4 and SR3 and the transporting direction of a partial transporting path at least between the route creating device SR4 and the inserting means of the paper ejecting means is reversed. The cut paper is ejected from the paper ejecting means 73 toward the post processing machine C through the rear portions of the sixth transporting route and the second transporting route.

(5) If MD3 and O1 are specified, (a) When inverted transporting is not specified, In this case, the third transporting route R3 is established first by activating the route creating devices SR1 and SR2. Then, the main printer A feeds the cut papers from the main paper feeding means 4 to the printing means 5 like when MD1 and O1 are specified. After black and white printing is administered, the cut papers are ejected to the paper ejecting means 71.

The support printer B feeds the cut papers to the paper feeding means 92 of the printing means 9 through the third transporting route R3 and color printing is administered to the cut paper to which the black and white printing has been administered. After the printed cut papers are ejected from the paper ejecting means 92 of the printing means, the cut papers are transported to the paper ejecting means 10 through the fourth transporting route R4 like when MD2 and O1 are specified.

(b) When inverted transporting is specified, (a) Like (a) just above, the main printer A administer black and white printing to the cut papers, color prints the cut papers that are fed to the printing means of the support printer, and ejects them from the paper ejecting means 92 of the printing means. Then, like when MD2 and O2 are specified, the cut papers are transported to the rear of the second transporting route R2 through the fifth transporting route R5 and are transported to the inserting means 101 of the paper ejecting means 10 through the sixth transporting route R6.

(6) If MD3 and O2 are specified, (a) When inverted transporting is not specified, Until the printed cut papers are ejected from the paper ejecting means 92 of the printing means 9 of the support printer B after overlay printing of black and white and color are administered, the process is the same as when MD3 and O1 are specified. Then, like when MD2, O2 and non inverted transporting are specified, the cut papers are transported until they are ejected from the paper ejecting means 73 at the end of the second transporting route R2 through the fifth transporting route R5.

(b) When inverted printing is specified,

Until the main printer A administers black and white printing, the support printer B administers color printing, and the cut papers are ejected from the paper ejecting means 92 of the printing means 9, the process is the same as when MD3 and O1 are specified. Then, like when MD2, O2, and inverted transporting are specified, the cut papers are transported until they are ejected from the ejecting means 73 at the end of the second transporting route R2 through the fourth transporting route R4 and the sixth transporting route R6.

(7) If MD4 and O1 are specified, (a) When inverted transporting is not specified, In this case, the main printer A does not administer printing and the blank or the printed cut papers are transported from the main paper feeding means 4 to the paper ejecting means 71 through the support transporting route 62. The support printer B activates the route creating devices SR1 and SR2 of the cut paper transporting mechanism to establish the third transporting route R3 and the cut papers from the main printer are transported to the paper feeding means 91 of the printing means 9 of the support printer B through the third transporting route R3. When the rear end of the cut paper passes the route creating device SR2, the route creating device SR2 returns to the regular position to establish the fourth transporting route $4. That is, after the printing information given from the top device FB is printed by the printing means 9, the cut papers ejected from the paper ejecting means 92 of the printing means are transported to the inserting means 101 of the paper ejecting means 10 through the fourth transporting route R4.

(b) When inverted transporting is specified,

After the cut papers from the main printer A are fed to the printing means 9 of the support printer, the cut papers are controlled the same as when MD2, O1 and the invert transporting are specified.

(8) If MD4 and O2 are specified, (a) When inverted transporting is not specified, Until the cut paper is ejected from the paper ejecting means 92 of the printing means 9 of the support printer, the same process is administered as when MD4, O1, and non inverted transporting are specified. The route creating device SR2 moves by the time when the cut paper ejected from the paper ejecting means 92 reaches and the fifth transporting route R5 is established. Therefore, the printed cut papers are ejected from the paper ejecting means 73 toward the post-processing machine C through the fifth transporting route R5.

(b) When inverted transporting is specified,

Until the cut paper is ejected from the paper ejecting means 92 of the printing means of the support printer, the same process is administered as when MD4, O2, and non inverted transporting are specified. Then, like when MD2, O2, inverted transporting are specified, the cut papers are ejected from the paper ejecting means 73 toward the post processing machine C through the rear of the fourth transporting route R4, the sixth transporting route R6, and the second transporting route R2.

Also, if the cut paper transporting mechanism that is indicated in the FIG. 4 is used, the route creating devices are placed in necessary places and the invert transporting is administered if necessary by controlling these transporting devices when the cut papers are ejected either to the paper ejecting means 10 or to the post processing device C.

As in an example indicated in the FIG. 1, if the main printer A and the support printer B are stored in individual boxes 1 and 2, this invention can include the printer system by optionally and easily combining the main printer and the support printer with different specifications.

As indicated in the example in FIGS. 1 and 2, the main printer and the support printer have a common paper ejecting means. In comparison to using two ordinary printers, the size of the printer system can be minimized. And, if more than one paper ejecting tray of the paper ejecting means are used, the necessary number of the printed cut papers can be removed immediately and accurately by ejecting the printed papers from the main printer and the support printer to the paper ejecting tray. This example involves selectively ejecting printed cut papers that are ejected from the main printer or the support printer to either the paper ejecting means 10 of the support printer or exterior post processing machine C. This invention does not require the post-processing machine C to be connected. Contrary to the example, the main printer can be placed on the lower side of the support printer to print the previously color printed papers by the support printer and eject them to the post processing machine C. For example, after logos, emblems, and symbols are printed in color, various printing can be administered in black and white.

By placing a thin scanner on the top of the paper ejecting means 10 and electrically connecting it to the top device F or the control device EA, the said print system can be used as a copier and/or a facsimile.

As described, the invention administers overlay printing by either of two different printers or both printers. In either case, the printed cut papers are ejected to one of the paper ejecting means. Contrary to the ordinary method of using two independent printers, the printed cut papers can be easily removed and the occupying space is also reduced. Therefore, the price of the printer system is generally reasonable.

The invention can eject the printed cut papers after either or both black and white printing and color printing are administered to the paper ejecting means of the printer system. It can also selectively eject the printed cut papers to the post-processing machine that is connected to the printer system to administer post processing after the printing. It adds diversity to the form and contents of the printing. It can also administer color printing and black and white printing to different papers at different times or at the same time, and it is easy to establish the transporting routes, and, since the means for establishing the routes is symmetrical, an installer does not need to distinguish the installation direction.

The scope of the invention is defined by the following claims.

What is claimed is:

1. A printing system comprising: a main printer and a support printer, each said printer having paper sheet feeding means, paper sheet transport means, and paper sheet printing means for printing sheets of paper supplied from said transport means by said paper feeding means, means for setting the route of travel of sheets of paper exiting said main printer and said support printer, means for receiving sheets of paper directed thereto by said means for setting the route, and transport control means for controlling transport of sheets of paper through the route established by said means for setting the route, wherein the means for setting the route is a device operable to direct sheets of paper to and from both vertical directions and both horizontal directions and from said either printer horizontally to said means for receiving sheets.

2. The printer system as defined in claim 1, wherein the means for transporting sheets has routes to transport sheets of paper from said main printer to said means for receiving sheets from said main printer and said support printer.

3. The printer system as defined in claim 2, wherein said means for transporting sheets has means for inverting the sheets.

4. A printing system comprising a main printer and a support printer, each said printer having paper sheet feeding means, paper sheet transport means, and paper sheet printing means for printing sheets of paper supplied from said transport means by said paper feeding means, means for setting the route of travel of sheets of paper exiting said main printer and said support printer, means for receiving sheets of paper directed thereto by said means for setting the route, and transport control means for controlling transport of sheets of paper through the route established by said means for setting the route, wherein the means for setting the route is a device operable to direct sheets of paper to and from both vertical directions and both horizontal directions and from said either printer vertically to said means for receiving sheets.

5. A printer system as defined in claim 4, wherein the means for transporting sheets has routes to transport sheets of paper from said main printer to said means for receiving sheets from said main printer and said support printer.

6. The printer system as defined in claim 5, wherein said means for transporting sheets has means for inverting the sheets.

7. A printing system comprising a main printer and a support printer, each said printer having paper sheet feeding means, paper sheet transport means, and paper sheet printing means for printing sheets of paper supplied from said transport means by said paper feeding means, means for setting the route of travel of sheets of paper exiting said main printer and said support printer, means for receiving sheets of paper directed thereto by said means for setting the route, and transport control means for controlling transport of sheets of paper through the route established by said means for setting the route, wherein the means for setting the route has four curved paths connected by diverging or merging points of two straight paths forming a crossed shape and in reversed symmetry around said crossed shape.

* * * * *